US006247541B1

(12) United States Patent
Ellis et al.

(10) Patent No.: US 6,247,541 B1
(45) Date of Patent: Jun. 19, 2001

(54) METHOD OF DRIVE PIPE REPLACEMENTS ON OFFSHORE PLATFORMS

(75) Inventors: Harvey Andrew Ellis, Katy, TX (US); George Virgil LeJeune, Jennings, LA (US)

(73) Assignee: Vastar Resources, Inc., Chicago, IL (US)

( * ) Notice: Subject to any disclaimer, the term of this patent is extended or adjusted under 35 U.S.C. 154(b) by 0 days.

(21) Appl. No.: 09/432,448

(22) Filed: Nov. 2, 1999

(51) Int. Cl.[7] ..... E21B 29/12; E21B 7/136; E21B 7/06

(52) U.S. Cl. ..... 175/9; 175/80; 175/82; 166/277; 166/380

(58) Field of Search ..... 166/277, 342, 166/349, 341, 380, 381, 384, 385, 117.5, 117.6, 241.1, 241.5, 50, 98; 175/9, 61, 80, 82, 78, 79, 81, 5, 8

(56) References Cited

U.S. PATENT DOCUMENTS 4,249,619 2/1981 Burns ..... 175/9
4,526,232 7/1985 Hughson et al. ..... 166/277 X
4,733,732 3/1988 Lynch ..... 175/9

OTHER PUBLICATIONS

Brochure : "Whip Stock"; Petro–Drive, Inc; undated.

*Primary Examiner*—David Bagnell
*Assistant Examiner*—Sunil Singh
(74) *Attorney, Agent, or Firm*—F. Lindsey Scott; Robert E. Sloat

(57) ABSTRACT

A method for replacing an old drive pipe in a slot on an offshore platform. The old drive pipe is first cut to provide an upper portion and a stub portion which remains firmly embedded in said marine bottom. Next, a guide cable is affixed to the stub portion of the old drive pipe and extends to the platform. The upper portion is then retrieved to the surface. A new drive pipe which carries a whipstock at its lower end is then made-up and lowered over the guide cable until the whipstock engages the stub portion where the new drive pipe is then diverted by the whipstock into a different path from that of the old drive pipe.

13 Claims, 3 Drawing Sheets

METHOD OF DRIVE PIPE REPLACEMENTS ON OFFSHORE PLATFORMS

DESCRIPTION

1. Technical Field

The present invention relates to a method for reclaiming an unused or unusable slot on an offshore platform by replacing the drive pipe originally positioned within said slot and in one aspect relates to replacing an unused drive pipe on an offshore platform by severing and removing the upper portion of the old drive pipe and then using a tethered guide cable to guide a new drive pipe into a position which bypasses the path of the old drive pipe.

2. Background

In producing hydrocarbons from subsea deposits, it is common to drill and complete a plurality of wells from the same offshore structure; i.e. bottom-supported platforms, tethered platforms, etc. In structures of this type, a plurality of "slots" are provided through which individual drive pipes (sometimes called "conductors") are run through guides on the platform and are driven to refusal or otherwise penetrated to a desired depth into the marine bottom. A well is then drilled and completed through each of the drive pipes by techniques, e.g. directional drilling, well known in the art.

Unfortunately, when a well is being drilled, completed, or produced, the drive pipe in a particular slot may become clogged or damaged below the mud line or the wellbore from the drive pipe may be proceeding along a undesirable path (e.g. intersection with another wellbore). When this happens, an attempt is usually made to salvage the effected slot by clean-out or some other remedial technique. If these measures, usually expensive and time-consuming, are unsuccessful, the slot may have to be abandoned. Also, if a well turns out to be a dry hole or does not produce at an economical rate, the slot will have to be abandoned. Since the number of slots on any particular platform is limited, it is highly desirable to "reuse" a slot rather than abandon it.

One highly successful technique for reclaiming an unused or unusable slot on an offshore platform is that disclosed in U.S. Pat. No. 4,733,732 to Lynch, issued Mar. 29, 1988. The original or "old" drive pipe in the effected slot is first cut or severed below the marine bottom or mudline. The upper portion of the old drive pipe is retrieved to the surface, leaving the lower portion or old stub pipe in place. In the preferred embodiment, a "sub-mudline drive pipe whipstock" ("SDW") is attached to the lower end of the new drive pipe which, in turn, is then passed or driven downward through the same set of vertically-spaced guides on the platform that were used in positioning the old drive pipe. Thus, as disclosed in U.S. Pat. No. 4,733,732, the SDW is self-aligning onto the old stub pipe where it becomes firmly seated.

Once the SDW is in place on the old stub pipe, continued downward force on the new drive pipe will shear the bolts holding the SDW to the new drive pipe. As the new drive pipe moves downward, it will engage the inclined surface of the whipstock and will be deflected thereby into a new direction. Also, in another modification, the SDW is lowered on the lower end of a drill string which is retrieved to the surface after the SDW is properly positioned on the old stub pipe. While not disclosed in U.S. Pat. No. 4,733,732, the drill pipe may remained connected to the SDW after the SDW is in place and the new drive pipe can be lowered over the drill pipe which, in turn, serves as a guide to insure the path between the surface and the old stub pipe.

While drill pipe is useful as a guide string in relatively shallow water depths, it is impractical, if not impossible, to design a drill pipe and/or drill collar guide string using present technology and commercially-available supplies which would free-stand under its own weight and/or withstand the dynamic conditions of ocean currents and wave action (i.e. column buckle problem) in water depths of about 250 feet or greater. Accordingly, some means is needed to replace drive pipes in water depths which exceed about 250 feet.

SUMMARY OF THE INVENTION

The present invention provides a method for replacing an old drive pipe which extends through a slot on an offshore platform, especially where the platform is positioned in a deep body of water (e.g. 250 feet or more). The old drive pipe is a damaged or otherwise unusable conductor pipe which extends from a deck on the platform, through the body of water, and into the marine bottom to a depth below the mudline. To replace the old drive pipe, it is first cut to provide an upper portion and a stub portion, the latter remaining firmly embedded in said marine bottom. Next, a guide cable is affixed to the stub portion of the old drive pipe so that the guide cable will extend between the stub portion and the deck on the platform. The upper portion is removed from the slot on the platform as the upper portion is retrieved to the surface.

A new drive pipe is then made-up as it is lowered over the guide cable and passes through the same slot as previously occupied by the old drive pipe. The new drive pipe will be guided downward along the guide cable until it reaches the stub portion of said old drive pipe where it is then diverted away from the stub portion of said old drive pipe into a different path from that of said old drive pipe.

More specifically, the present method is carried out by first setting an anchor packer, having a central bore therethrough, in the old drive pipe at a point below the mudline. The old drive pipe is then cut at a point above the anchor packer to thereby provide an upper portion and a stub portion which, in turn, remains firmly embedded in said marine bottom. Next, a retrievable packer, having a central bore therethrough, is set in the upper portion of the old drive pipe near the cut point.

A guide cable assembly, comprised of the necessary length of cable having a shearable tool at the lower end thereof, is releasably connected by a J-slot connector or the like to a work string and is lowered thereby down the old drive pipe. The cable will pass through the central bores of both the retrievable packer and the anchor packer until the releasable connector comes to rest on the retrievable packer. The work string is then released and retrieved to the surface.

The upper portion of the old drive pipe is then raised to the surface. Since the retrievable packer is firmly set in the upper portion of the old drive pipe and the releasable connector on the cable rests on the retrievable packer, they too will be raised as the upper portion of the old drive pipe is raised. This draws the cable back up through the bore in the anchor packer until the shearable tool on the lower end of the cable assembly engages the anchor packer and holds it against further upward movement. At this time, the retrievable packer and the upper end of the cable has reached the surface.

A whipstock assembly having either a stab-in or stab-over connection thereon is releasably connected to the lower end of a new drive pipe by shearable bolts or the like. The drive pipe and the whipstock connection are threaded over the guide cable and are lowered through the same slot as that previously used by the old drive pipe. Make-up of the new drive pipe continues as it is lowered down over said guide cable until the whipstock assembly engages the stub portion of said old drive pipe. Now continued downward force on the new drive pipe will cause the bolts to shear thereby releasing the new drive pipe from the whipstock assembly and causing the new drive pipe to be diverted into a different path from that taken by the old drive pipe.

BRIEF DESCRIPTION OF THE DRAWINGS

The actual construction, operation, and apparent advantages of the present invention will be better understood by referring to the drawings which are not necessarily to scale and in which like numerals identify like parts and in which.

BEST KNOWN MODE FOR CARRYING OUT THE INVENTION

Figure 1:
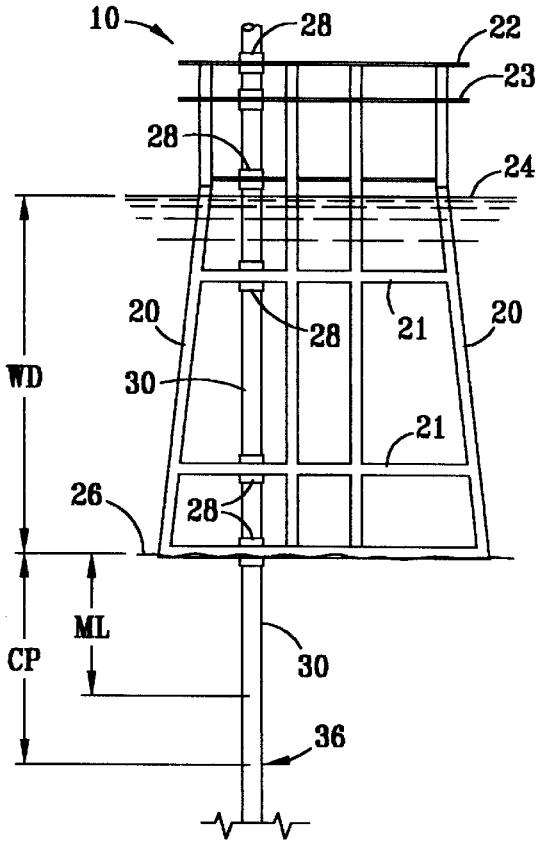
FIG. 1 is a perspective view of a simplified, elevational view of an offshore platform illustrating an old, unusable drive pipe which needs to be replaced.

Referring more particularly to the drawings, FIG. 1 illustrates a typical offshore structure, i.e. fixed platform 10, from which a plurality of wells are to be drilled and completed. As illustrated, platform 10 is comprised of legs 20 which are connected together by standard-like, cross-bracing 21. As will be understood, conventional drilling/production equipment (not shown) will be positioned on decks 22, 23, located at the upper ends of legs 20 above the water surface 24.

Figure 2:
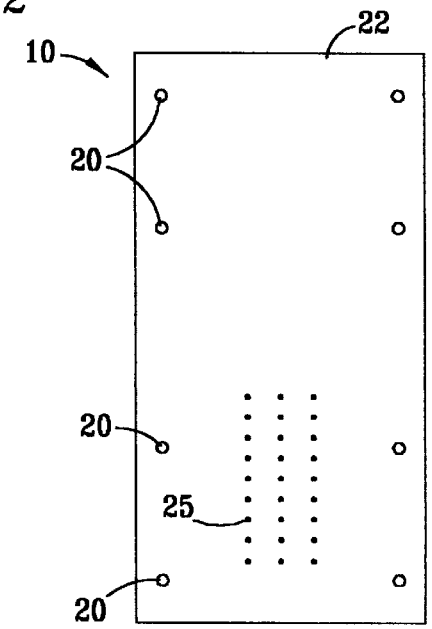
FIG. 2 is a top view of the upper deck of the offshore platform of FIG. 1.

As shown in FIG. 2, platform 10 is provided with a plurality of "slots" 25 (only one numbered). As will be understood in the art, a slot is a term which refers to an individual path through which a well is to be drilled from the platform. In order to drill a well through slot 25, a drive pipe or conductor 30 (FIG. 1) is lowered through a set of vertically-aligned guide sleeves 28 which, in turn, are affixed to decks 22, 23, and respective cross-braces 21 and is driven to refusal in marine bottom 26 or to a predetermined depth therein. Once drive pipe 30 is properly positioned, a well (i.e. a directional wellbore) can be drilled therethrough using conventional drilling operations. The drive pipe provides a closed fluid path between the marine bottom and the surface through which fluids (e.g. drilling mud) can circulate during drilling, completion, and production of the well.

Unfortunately, a drive pipe may become unusable for a variety of reasons either during installation or during its operational life. For example, the drive pipe may become clogged or damaged so that it can no longer serve its desired function. Likewise, a well drilled through the drive pipe may be dry or may produce at an uneconomical rate. In any of such events, the slot associated with the unusable drive pipe has to be abandoned unless the old drive pipe can be replaced with a new one. This is extremely important since the number of slots on a particular platform is limited. If unusable slots can not be salvaged, it may become necessary to set a second platform which is extremely expensive and may be prohibitive in certain situations.

Figure 3:
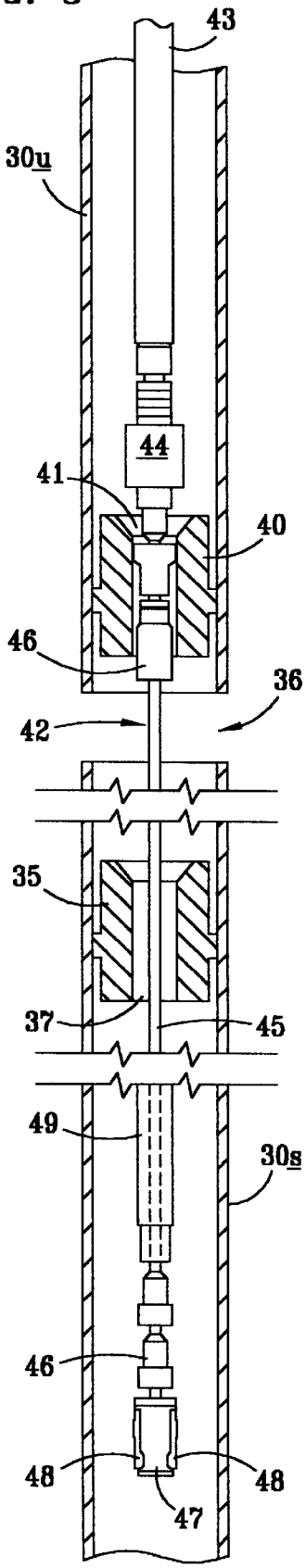
FIG. 3 is an enlarged, sectional view, showing the initial steps of the present invention.

The present invention provides a method for replacing an unusable drive pipe and is especially adaptable for use with platforms which are set in deep water depths ("WD" in FIG. 1) of about 250 feet or greater. Referring now to FIG. 3, once an old drive pipe occupying a slot on platform 10 has been determined to be unusable for any reason, an anchor packer 35 having a central bore 37 therethrough is lowered and set in old drive pipe 30 using well known techniques in the art. The depth at which anchor packer 35 is set is well below the point 36 at which drive pipe 30 is to be cut. For example, anchor packer 35 may typically be set approximately ±100 feet below the cut point 36 ("CP in FIG. 1) in old drive pipe 30. Cut point 36, in turn, is normally well below the mudline ("ML" in FIG. 1) which lies at the bottom of that zone which typically extends from about 50 to about 150 feet below marine bottom 26, depending on a particular offshore location. Of course, if drive pipe 30 has been used to complete a live well, the well will first be "killed" in accordance with conventional procedures.

After anchor packer 35 has been set, old drive pipe 30 is severed or cut at cut point 36 by using any of several well known casing cutting techniques, thereby producing an upper portion 30*u* and a stub portion 30*s*, the latter remaining firmly embedded in marine bottom 26. Once old pipe 30 has been cut, a second or retrieving packer 40 having a central bore 41 therethrough is lowered and set near the lower end of upper portion 30*u*. Next cable guide line assembly 42 is releasably connected to the lower end of a work string 43 (e.g. drill pipe) 43 by any applicable, conventional releasable connector 44 (e.g. J-slot connection). The cable guide line assembly 42 is comprised of a length of relatively-flexible cable 45 (e.g. galvanized steel cable, e.g. from about ¾ inch to about 1½ inches in diameter) having cable swivels 4–6 at either end. The upper swivel connects the cable 45 to the J-slot connector 44 while the lower swivel connects the cable to shearable anchor tool 47. Swivels 46 prevent cable 45 from twisting or kinking as it is lowered into drive pipe 30, as will be understood in the art.

Cable 45, when fully extended, must be long enough to extend from the surface to a point below the anchor packer 35. For example, for a platform set in a water depth of 250 feet and having a deck 22 which extends 70 feet above the surface 24, if old drive pipe 30 is cut 150 feet below the marine bottom 26 and anchor packer 35 is set 100 feet below the cut point 36, the cable 45 will have to be at least 570+ feet long as will understood from the following description. That is, the cable 45 has to reach from anchor packer 35 to deck 22 with some addition length being required to carry out the necessary guiding operation.

Figure 4:
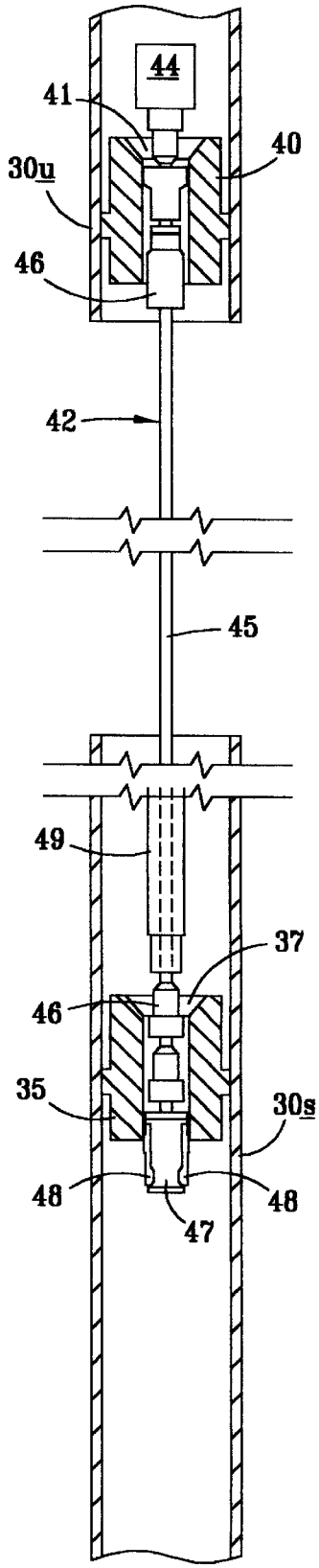
FIG. 4 is an enlarged section view, similar to that of FIG. 3; showing further steps of the present invention.

The guide cable assembly 42 is connected through J-slot connection 44 to the lower end of work string 43 and is lowered thereby down through the upper portion 30*s* of old drive pipe 30. As the shearable anchor tool 47 on the lower end of assembly 42 contacts the top of retrievable packer 40, it is directed by the taper at the top of bore 41 into bore 41 and will pass on therethrough. Before lowering assembly 42, it may be desirable to position one or more lengths of pipe 49 (e.g. drill pipe, only a portion shown in FIGS. 3 and 4), over the lower end of cable 45 above lower swivel 46. This added pipe 49 provides rigidity at the lower end of the guide assembly 42 which is beneficial in threading the otherwise flexible cable 45 through the bores in the respective packers.

Also, this pipe adds weight to the assembly which greatly assists in lowering the flexible cable and in keeping the cable substantially extended as it is being lowered.

Continued lowering of cable assembly 42 will now cause the shearable anchor tool 47 to contact anchor packer 35 and will be directed by the taper at the top of bore 37 into bore 37 so that cable assembly will pass completely through first packer 35. Cable 45 will continue to pass through both packers 35, 40 until releasable connector 44 engages the top of bore 41 in second or retrievable packer 40 where it comes to rest. Drill string 43 is then released at connector 44 (e.g. "un-jayed) and is retrieved to the surface.

Next, upper portion 30*u* of old drive pipe 30 is raised to the surface. Since second or retrievable packer 40 is set in upper portion 30*u* and cable assembly 42 rests thereon, they are effectively connected to upper portion 30*u* so they too will be raised with upper portion 30. As cable assembly 42 is raised, cable 45 will be drawn back through bore 37 of anchor packer 35 until shearable tool 47 engages the bottom of anchor packer 35 (see FIG. 4). While shearable tool 47 may take different forms without departing from the present invention, as shown in the figures, tool 47 is comprised of a body which supports a plurality of ratchet-like latches or lugs 48 which cam inwardly as the assembly 42 is lowered but which stay extended when assembly is moved upward in an opposite direction. The lugs 48, when extended, will engage the lower surface of packer 35 and thereby prevent cable assembly 42 from moving any further upward through the bore 37 in packer 35. As pointed out above, the overall length of cable 45 is such that tool 47 will engage the bottom of packer 35 as the upper end of the cable plus a few extra feet is retrieved at deck 22 of platform 10.

Figure 6:
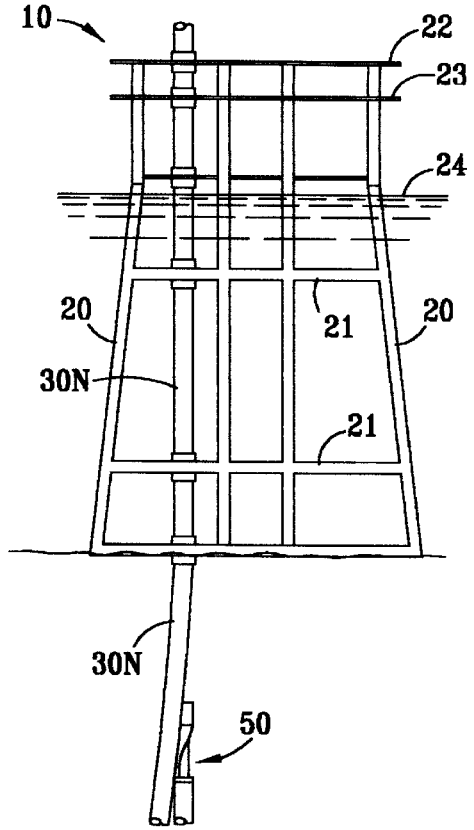
FIG. 6 is a perspective view of the offshore platform of FIG. 1 after a new drive pipe has been installed by using the present invention.

The last joint of the retrieved upper portion 30*u* of old drive pipe 30 and retrievable packer 40 are removed off of the upper end of cable 42 upon reaching deck 22. New drive pipe 30N (FIGS. 5A, 5B, and 6) is then ready to be installed through the same slot as was previously used by old drive pipe 30. First, whipstock assembly 50 is secured to the lower end of new drive pipe 30N. Whipstock assembly 50 is comprised of a hollow support 52 having a deflecting trough 53 affixed at an angle thereon. Trough 53 is secured to the lower end of new drive pipe 30N by shearable bolts 51 or the like and has an opening 54 therethrough which communicates with hollow support 52.

Figure 5A:
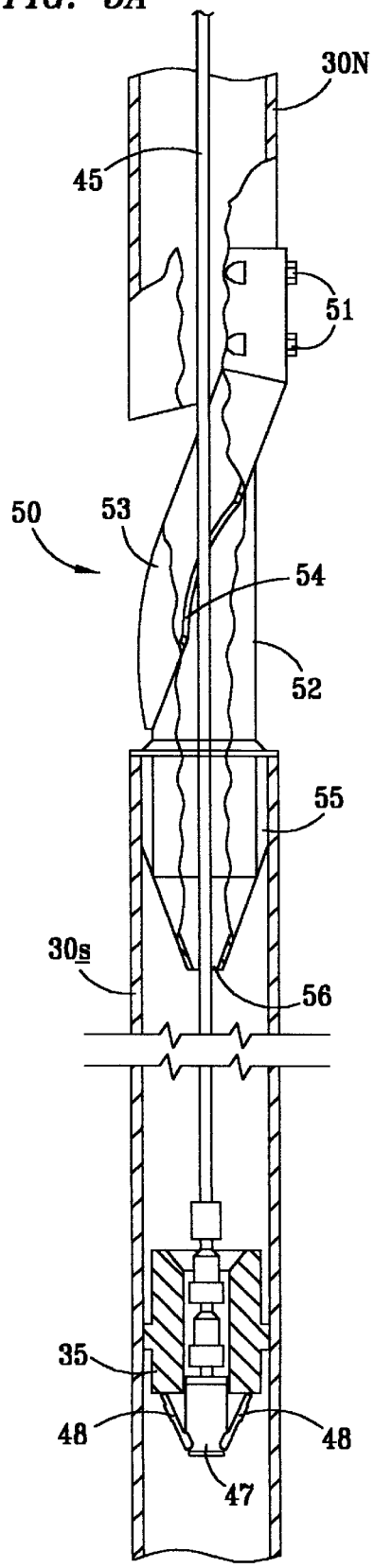
FIG. 5A is a detailed view of a "stab-in" whipstock used in the present invention.
Figure 5B:
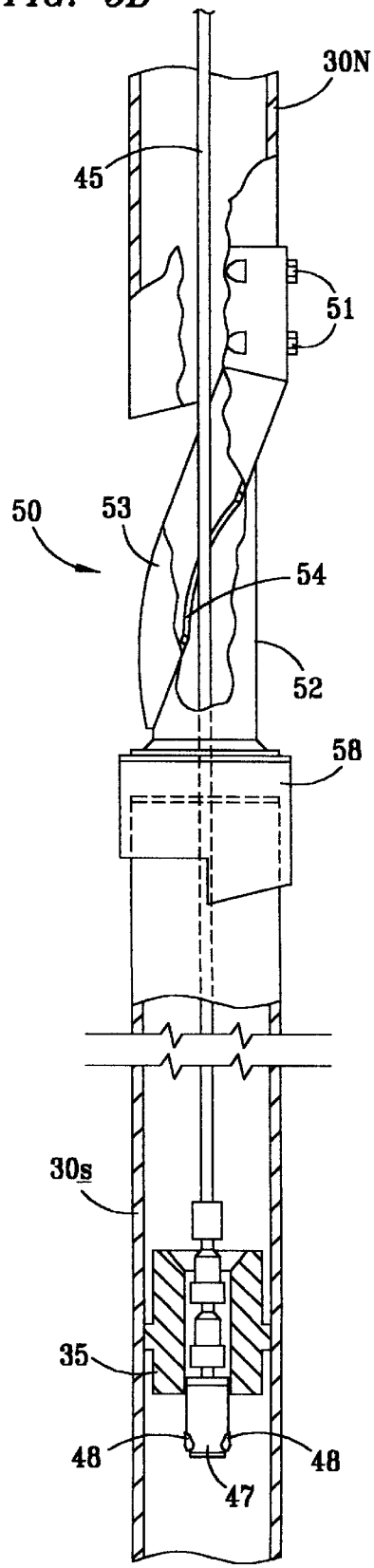
FIG. 5B is a detailed view of a "stab-over" whipstock used in the present invention.

FIG. 5A illustrates a "stab-in" type whipstock assembly 50 wherein a spear-like element 55 is affixed to the lower end of support 52 and is adapted to be received in stub portion 30*s* of old drive pipe 30 when whipstock assembly 50 is in its operable position. Spear element 55 has an opening 56 in the tip thereof to allow the passage of cable 45 therethrough. FIG. 5B illustrates a "stab-over" type of whipstock assembly 50 wherein a stab-over shoe 58 is affixed to the lower end of support 52 and is adapted to be received over stub portion 30*s* of old drive pipe 30 when whipstock assembly 50 is in its operable position.

Whipstock assembly 50 is secured to the lower end of new drive pipe 30N by shearable means 51 and is lowered over guide cable 45. If a stab-in whipstock assembly 50 (FIG. 5A) is used, the cable will be passed up through opening 56 in the tip of spear 55, through hollow support 52, through the opening 54 in trough 53, and up through the first joint of new drive pipe 30N. If a stab-over whipstock assembly 50 (FIG. 5B) is used, the cable 45 is threaded up through the stab-over shoe 58, etc. The new drive pipe 30N is then passed down through the same set of guide sleeves 28 on platform 10 as were used for the old drive pipe 30. Additional joints of new drive pipe 30N are added as the new drive pipe is lowered over extended guide cable 45 until whipstock assembly 50 is seated onto stub pipe 30*s* of old drive pipe 30.

Once whipstock assembly 50 is in place on stub pipe 30*s*, upward force is applied to cable 45 thereby shearing lugs 48 and which, in turn, releases cable 45 and allows it to be retrieved to the surface. Next, downward driving force is applied to new drive pipe 30N which, in turn, shears bolts 51, thereby releasing new drive pipe 30*s* from whipstock assembly 50. As new drive pipe 30N then is driven downward, it will be deflected along the angled surface of trough 53 into its new or different path (see FIG. 6) where it will now be ready for the drilling of a new well. This completes the reclaiming of an otherwise unusable slot on platform 10. The method can be repeated as needed for reclaiming other slots 25, if and when the need arises.

What is claimed is:

1. A method for replacing an old drive pipe which extends through a slot on an offshore platform positioned in a body of water, said old drive pipe extending from a deck on said platform, through said body of water, and into the marine bottom to a depth below the mudline, said method comprising:

cutting said old drive pipe to provide an upper portion and a stub portion which remains in said marine bottom;

affixing a guide cable to said stub portion, said guide cable extending upward to said deck on said platform; and removing said upper portion of said old drive pipe from said slot;

lowering a new drive pipe through said slot and over said guide cable down to said stub portion of said old drive pipe; and diverting said new drive pipe away from said stub portion of said old drive pipe to direct said new drive pipe in a different path from that of said old drive pipe.

2. The method of claim 1 wherein said step of affixing said guide cable to said stub portion of said old drive pipe comprises:

setting an anchor packer within said stub portion of said old drive pipe; and lowering said guide cable through said old drive pipe; and attaching the lower end of said guide cable to said anchor packer.

3. The method of claim 2 wherein said anchor packer is set in said stub portion of said old drive pipe before said old drive pipe is cut.

4. The method of claim 2 including:

retrieving said guide Cable to said deck of said platform before diverting said new drive pipe into said different path.

5. The method of claim 4 wherein said step of diverting said new drive pipe comprises:

releasably connecting a whipstock assembly to the lower end of said new drive pipe;

lowering said whipstock assembly and said new drive pipe over said guide cable until said whipstock assembly engages said stub portion of said old drive pipe;

applying downward force to said new drive pipe to release said new drive pipe from said whipstock assembly; and continuing downward force on said new drive pipe to divert said new drive pipe off said whipstock into said different path.

6. The method of claim 1 wherein said old drive pipe is cut at a point below said mudline.

7. A method for replacing an old drive pipe which extends through a slot on an offshore platform positioned in a body of water, said old drive pipe extending from a deck on said platform, through said body of water, and into the marine bottom to a depth below the mudline, said method comprising:

setting an anchor packer having a central bore therethrough in said old drive pipe at a point below said mudline;

cutting said old drive pipe at a point above said anchor packer to provide an upper portion and a stub portion which remains in said marine bottom, said stub portion having said anchor packer set therein;

setting a retrievable packer having a central bore therethrough in said upper portion of said old drive pipe;

lowering a guide cable assembly down said old drive pipe and through said central bores of said retrievable packer and said anchor packer; said guide cable comprising a length of cable having a releasable connector on the lower end thereof;

affixing the lower end of said guide cable assembly to said anchor packer in said stub portion by means of said releasable connector, said length of said guide cable extending upward to said deck on said platform when said lower end of said guide cable assembly is affixed to said anchor packer;

removing said upper portion of said old drive pipe upward through said slot along with said retrievable packer;

lowering a new drive pipe through said slot and over said guide cable down to said stub portion of said old drive pipe; and diverting said new drive pipe away from said stub portion of said old drive pipe to direct said new drive pipe in a different path from that of said old drive pipe.

8. The method of claim 7 wherein said old drive pipe is cut at a point below said mudline.

9. The method of claim 8 including:

releasing said guide cable assembly from said anchor packer and retrieving said guide cable assembly to said deck of said platform before diverting said new drive pipe into said different path.

10. The method of claim 9 wherein said step of diverting said new drive pipe comprises:

releasably connecting a whipstock assembly to the lower end of said new drive pipe;

lowering said whipstock assembly and said new drive pipe over said guide cable until said whipstock assembly engages said stub portion of said old drive pipe;

applying downward force to said new drive pipe to release said new drive pipe from said whipstock assembly; and continuing downward force on said new drive pipe to divert said new drive pipe off said whipstock into said different path.

11. The method of claim 10 wherein said whipstock assembly includes a stab-in, spear element which is adapted to be received within the top of said stub portion of said old drive pipe to thereby affix said whipstock assembly to said stub portion.

12. The method of claim 10 wherein said whipstock assembly includes a stab-over shoe which is adapted to be received around the top of said stub portion of said old drive pipe to thereby affix said whipstock assembly to said stub portion.

13. The method of claim 10 wherein the step of lowering said guide cable assembly comprise:

releasably connecting said guide cable assembly to the lower end of a work string;

lowering said guide cable assembly on said work string in said old drive pipe until said cable has passed through said bores in both said retrievable packer and said anchor packer and the upper end of said guide cable assembly contacts said retrievable packer;

releasing said guide cable assembly from said work string; and retrieving said work string.

* * * * *